United States Patent [19]

Lerner et al.

[11] Patent Number: 4,899,520

[45] Date of Patent: Feb. 13, 1990

[54] PACKAGING APPARATUS AND METHOD

[75] Inventors: Bernard Lerner, Peninsula; John Gereby, Rocky River; Rick Wehrmann, Hudson, all of Ohio

[73] Assignee: Automated Packaging Systems, Inc., Twinsburg, Ohio

[21] Appl. No.: 174,824

[22] Filed: Mar. 29, 1988

[51] Int. Cl.[4] ..... B65B 43/06; B65B 43/36

[52] U.S. Cl. ..... 53/459; 53/202; 53/469; 53/477; 53/389; 493/239

[58] Field of Search ..... 53/202, 469, 459, 468, 53/467, 567, 389, 477, 373; 493/234, 227, 239, 209

[56] References Cited

U.S. PATENT DOCUMENTS

| | | | |
|---|---|---|---|
| 3,138,074 | 6/1964 | Hartbauer | 493/239 X |
| 3,477,196 | 11/1969 | Lerner . | |
| 3,815,313 | 6/1974 | Heisler | 53/168 X |
| 3,815,318 | 6/1974 | Lerner | 53/384 X |
| 3,882,656 | 5/1975 | Lerner . | |
| 3,938,299 | 2/1976 | Lerner | 53/469 X |
| 3,956,866 | 5/1976 | Lattur | 53/459 |
| 3,965,653 | 6/1976 | Lerner | 53/373 X |
| 4,014,154 | 3/1977 | Lerner . | |
| 4,041,846 | 8/1977 | Lerner . | |
| 4,202,153 | 5/1980 | Lerner et al. | 53/459 |
| 4,586,318 | 5/1986 | Litt et al. | 53/459 |
| 4,651,506 | 3/1987 | Lerner et al. | 53/459 |

OTHER PUBLICATIONS

Gloucester/Sheldahl 360 41/56 Polybag Machine Advertisement (1981).

Gloucester 370 Series Polybag Machine 30/41/56 Advertising Brochure (1986).

"A Table That . . . Counts" Advertising Brochure of Gloucester Engineering Company, Inc. (1981).

*Primary Examiner*—James F. Coan

*Attorney, Agent, or Firm*—Watts, Hoffmann, Fisher & Heinke Co.

[57] ABSTRACT

A packaging machine and method for simultaneously loading, sealing and severing bags forming part of at least two independent chains of bags. Two juxtaposed nip roll assemblies including axially aligned feed roll portions can be independently actuated in order to selectively feed one or two webs. A drive motor, having a dual output, is selectively coupled to the nip roll assemblies by clutch/brake units which can be selectively actuated. After a bag or bags are loaded, a sealing mechanism is actuated to seal the loaded bag or bags. A sensor monitors movement in a seal unit member and terminates the sealing cycle if movement in the seal member occurs prior to the pressure bar reaching a predetermined position. While a bag or bags are being sealed, a tear off mechanism including a rod-like member is advanced into and through the web path in order to sever the loaded bag from the remainder of the web. Actuators operatively connected to distal ends of the member are actuated sequentially in order to move one end of the rod into contact with the web before the other end makes contact. As a consequence, severance of a bag along a line of weakness begins at one marginal edge of the bag and proceeds towards its opposite marginal edge. In an alternate embodiment, the stepper motor drive is used to advance bags to a loading station and when using loading funnels, are used to retract the bag in order to have a mouth of the bag engage a loading funnel. In addition, the stepper motor drive can be used to sever loading bags from the remainder of the web by reverse feeding the webs either concurrently or in a staggered relationship.

23 Claims, 10 Drawing Sheets

PACKAGING APPARATUS AND METHOD

TECHNICAL FIELD

The present invention relates generally to packaging systems and in particular to a method and apparatus for loading and separating a container from a chain or web of containers.

BACKGROUND ART

Various methods and apparatus for packaging articles in plastic bags are available today or have been suggested in the past. In one packaging method, the bags form part of a continuous plastic web, each bag being connected to a contiguous bag along a line of weakness. Typically, the bags define an opening on one face through which the bag is loaded.

In early bagging machines, an operator manually loaded the product into the bag and the bag was pulled downwardly to position the next bag at the loading station. The loaded bag was then manually severed from the web.

Machines and methods for automatically loading a chain of interconnected plastic bags have been developed or have been suggested by the prior art. In general, these machines include a mechanism for sequentially feeding a lead bag to a loading station; a mechanism for expanding the mouth of the bag and maintaining it in the expanded condition during a loading operation; and, a mechanism for severing the loaded bag from the chain. After the loaded bag is severed, the packaging sequence begins again with the next bag.

The individual bags are usually joined to the chain or web by a line of weakness generally formed by a plurality of perforations. After the bag is loaded, it is severed from the web along the perforations. Various mechanisms for automatically severing the loaded bag from the web have been developed or suggested. In one known method, the separation along the perforations is initiated by a projection that begins the tearing action near the center of the line of weakness. Severance of the bag then commences at the center of the line of weakness and proceeds outwardly toward the marginal edges. An example of such a mechanism is shown in U.S. Pat. No. 3,477,196, which is owned by the present assignee.

An alternate method for severing a loaded bag from the web is disclosed in U.S. Pat. No. 4,202,153 which is also owned by the present assignee. In the method and apparatus shown in this patent, a transversely movable product carrier enters an opened bag, positioned horizontally, and simultaneously loads the bag and severs it from the web. Severance is achieved by overdriving the product carrier so that it engages the bottom of the loaded bag and drives it away from the web while the remainder of the web is held stationary, thus tearing the loaded bag from the web. In the disclosed apparatus, the perforation breakage commences near the marginal edges of the web and advances inwardly from the marginal edges toward the center. Because the perforations are broken serially, the force needed to sever the container is less than that required if the perforations were broken simultaneously.

In U.S. Pat. No. 3,815,318 (also owned by the present assignee), a packaging method and apparatus is disclosed which illustrates another apparatus for severing a loaded bag along a line of weakness. In this apparatus, the tearing action is produced by a pivoting mechanism which engages a loaded bag and pivots the bag about an axis located near one marginal edge while the web is held stationary. The tearing action then commences at a remote marginal portion and advances towards the edge of the bag that is located at or near the pivot axis.

A method and apparatus for simultaneously filling two adjacent bags have also been suggested in the past. In particular, U.S. Pat. No. 4,041,846, owned by the present assignee, illustrates detachable, interconnected container strips and a method of making these strips. The strips are connected in a side-by-side relationship in order to define adjacent bags. In this patent, however, the adjacent bags are attached and cannot move independently of each other prior to filling. After filling, the attached side-by-side bags are separated.

DISCLOSURE OF THE INVENTION

The present invention provides a new and improved packaging apparatus and method for sequentially loading, sealing and severing bags from a chain or web of interconnected bags. In particular, the disclosed apparatus and method is capable of simultaneously loading side-by-side positioned bags that form part of at least two independent webs and in addition includes an improved sealer and tear off mechanism. The mechanism is operative to seal and sever the loaded bags from their respective webs.

The present invention can also be used to load, seal and sever bags formed in webs of the type disclosed in U.S. Pat. No. 4,041,846. In particular, each web may comprise two side-by-side, interconnected strips of bags. In the illustrated embodiment of the invention, two such webs can be handled by the mechanism simultaneously in order to load four bags with each machine cycle.

According to the invention, the apparatus includes structure defining a feed path for at least two chains of interconnected bags extending from a supply station to a bag loading station. A web feed unit including a nip roll mechanism advances successive bags to the loading station. The web feed mechanism includes drive roll portions associated with each web that may be independently driven by a multiple output drive system.

According to the invention, a dual drive is utilized to independently drive at least two individual webs (each web may include two side-by-side, interconnected longitudinal strips of bags). In one embodiment, a drive motor having two output shafts is used. Each output shaft is connected through a clutch/brake mechanism to an associated nip roll assembly. In particular, each output shaft is operatively connected to a drive roll portion forming part of an associated nip roll assembly. With this construction, rotation of the motor output shaft can be selectively coupled to one or both drive roll portions to effect advancement of one or both webs.

In another embodiment, a stepper motor drive is employed utilizing individual stepper motors for selectively rotating the drive roll portions. In the stepper motor embodiment, each stepper motor is preferably coupled directly to an associated drive roll portion eliminating the need for clutch/brake units.

According to another feature of the invention, a tear off mechanism is selectively activated in order to separate the loaded bag from the rest of the web along a line of weakness, such as a line of perforations. In the preferred and illustrated embodiment, the tear off mechanism comprises a rod-like member extending transversely with respect to the web feed path which is movable into and through the web path by an actuating system. In the preferred embodiment, only a portion of the perforation breaking rod initially moves into the web feed path and preferably initially contacts the bag to be severed near one of its marginal edges. The tear off rod portion moves through the web path and begins the severance of the bag at the marginal edge. The remainder of the tear off member then moves through the web path to complete the severing operation. In short the tear off begins at one marginal edge of the loaded bag and proceeds towards the opposite marginal edge. With this arrangement, the tear off force necessary to sever the bag is reduced since the tear off does not have to occur concurrently across the entire width of the bag but proceeds gradually from one marginal edge to the other.

In the preferred and illustrated actuating system, the rod-like member is supported at its opposite ends by a pair of actuators, preferably fluid pressure operated. In the preferred control system, the actuation of one of the actuators is delayed or slowed so that one end of the tear off rod extends into and through the web path and begins the severing process before the other end of the rod moves into the web path. In the exemplary embodiment, this differential actuation is achieved by restricting the fluid pressure flow to one of the actuators in order to delay its extension.

According to another feature of the invention, the sealer assembly includes a monitoring system to prevent or inhibit the actuation of the sealer should an obstruction be present between a clamping bar and a heat sealing head. In the preferred embodiment, spring loaded grippers are positioned above and below a heating element. The position of the grippers with respect to the heating element is monitored by a gripper position sensor. During the sealing process, these grippers are moved to a retracted position as the clamping bar clamps the loaded bag between itself and the grippers. A clamping bar sensor is also used to monitor the position of the clamping bar. A sealer control circuit monitors the position of the grippers and the clamping bar and should the grippers move to a retracted position before the clamping bar reaches a predetermined location (which would indicate the presence of an obstruction between the clamping bar and the grippers), the control system immediately retracts the clamping bar to abort the sealing cycle. During a normal sealing cycle, only the plies of the bag should be located between the clamping bar and the grippers. Consequently, in normal operation, the grippers should not begin their movement towards a retracted position until the gripper bar is in very close proximity to the grippers i.e. less than one eighth of a inch from the grippers. Movement in the grippers before the clamp bar reaches the position at which it is in close proximity (i.e. one eighth of a inch away) from the grippers, is an indication that an obstacle or obstruction is present.

In one embodiment of the invention, a bag to be loaded is precisely positioned at a loading station by first sensing the location of a line of perforations (along which the loaded bag will ultimately be severed) and then continuing the advancement of the web for a predetermined time that corresponds to the time required for the bag to traverse the web path distance that must be traveled from the perforation detector to the bag loading station.

In the embodiment that employs the stepper motor drive arrangement, a slightly different control system can be used. In this latter embodiment, after the line of perforations in the web is detected, the web is advanced a predetermined number of steps that correspond to the web path distance between the sensed perforations and the bag loading position at the load station.

According to this embodiment, the a stepper motor control system can reverse feed a bag at the loading station in order to have a mouth of the bag engage a loading funnel, after the bag is opened.

According to another feature of this embodiment, the stepper motors and stepper motor control system can replace the function provided by the tear-off mechanism described above. In particular, after the bag or bags are loaded and are being held by the sealing mechanism, the stepper motors can be reverse actuated in order to retract the web. Since the bags are substantially immobilized by the sealing mechanism, the webs are severed from the bags along the respective lines of weakness (i.e. perforations) that join the bags to the webs. Moreover, the stepper motor control system can reverse actuate the stepper motors in a staggered relationship so that a differential retraction can be imparted to the webs so that tear-off begins on one web before commencing on the other web. With this arrangement, the severance does not occur simultaneously across the entire width of the bag or bags, and as a result, substantially less force is imparted to the web or webs by the stepper motors.

With the disclosed invention, a highly productive bagging machine can be realized. At least two bags, forming part of independent webs can be loaded, sealed and severed from the respective webs simultaneously. Thus for each machine cycle, two loaded bags can be produced. The disclosed machine can also load bags of dissimilar sizes and/or shapes, at the same time because each web is driven and controlled separately by the dual drive system. In addition, the web feed mechanism can operate in unison in order to drive a single web made up of wide bags that span both nip roll assemblies.

Although the invention has been described in connection with the feeding of two individual webs, with each web comprising a chain of interconnected bags joined along transverse lines of weakness, the present invention can also load, sever and seal webs of the type disclosed and claimed in U.S. Pat. No. 4,041,846. In particular, each web may comprise two interconnected, side-by-side strips of bags. With this type of web, four bags can be loaded, severed and sealed with each machine cycle.

Additional features of the invention will become apparent and a fuller understanding obtained by reading the following detailed description made in connection with the accompanying drawings.

BRIEF DESCRIPTION OF THE DRAWINGS

FIGS. IA and lB are front and rear perspective views, respectively, of a machine embodying the present invention.

BEST MODE FOR CARRYING OUT THE INVENTION

Figure 1A:
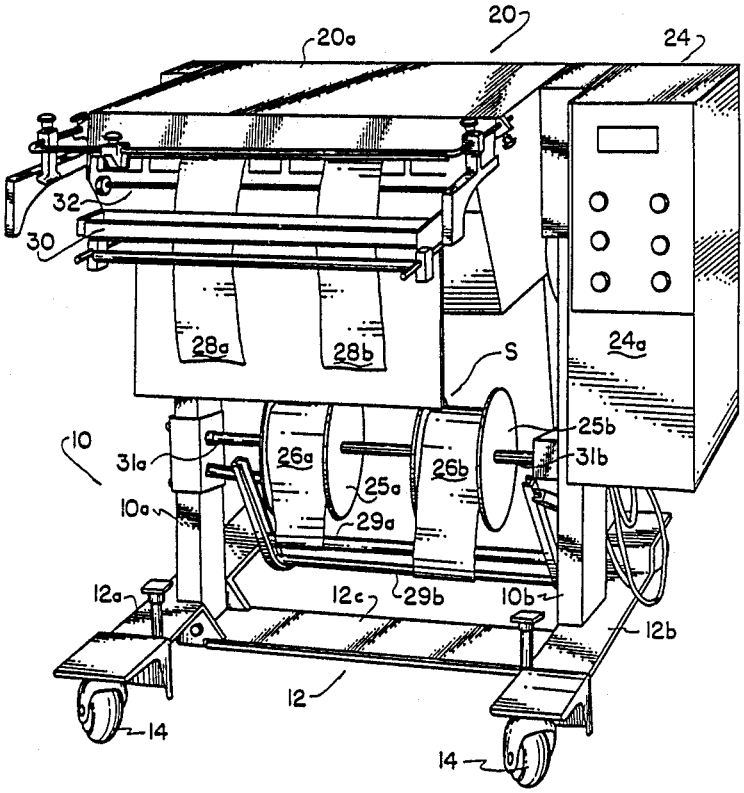
Figure 1B:
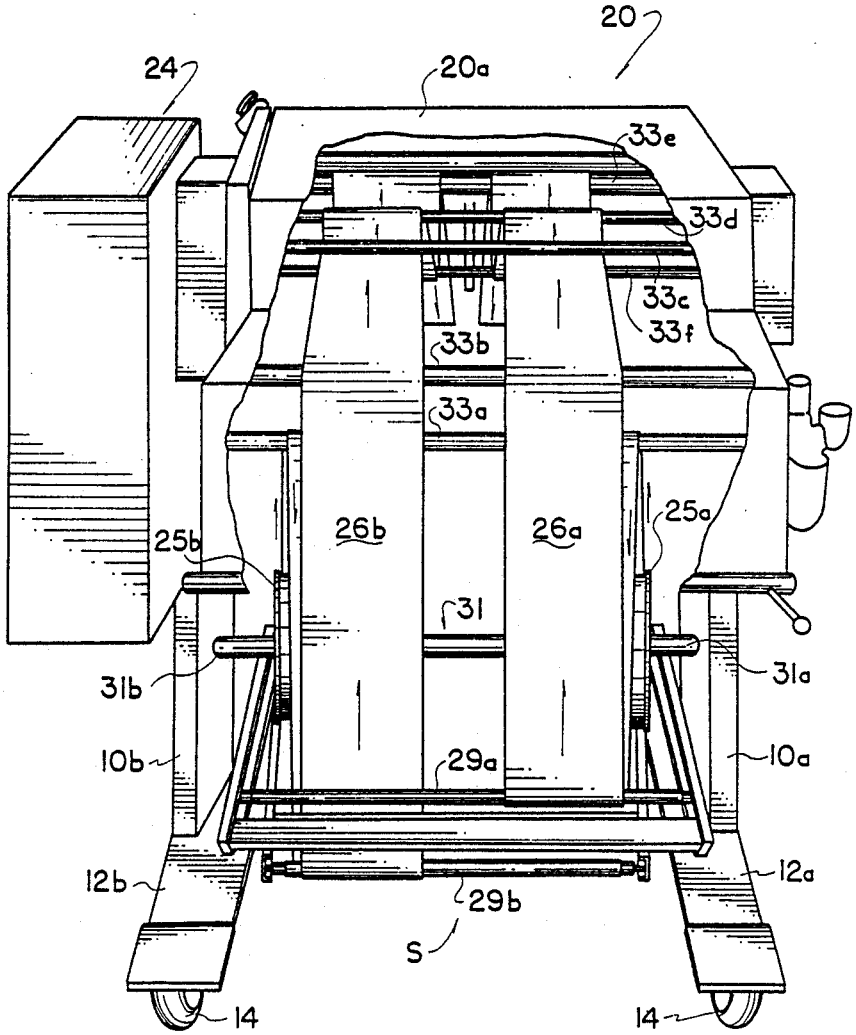

FIGS. 1A and 1B illustrate the overall construction of a packaging apparatus constructed in accordance with a preferred embodiment of the invention. The illustrated apparatus can be termed a "bagging machine" and is adapted to load bags interconnected to form a chain. The bags are preferably joined together along a line of weakness.

The bagging machine comprises of a support frame 10 defined by a pair of vertically standing uprights 10*a*, 10*b* sitting atop a base 12. The base 12 includes a pair of transversely extending members 12*a*, 12*ba* interconnected by a cross member 12*c*. A plurality of wheels 14 are located at distal ends of the transverse members 12*a*, 12*b* and enable the bagging machine to be moved about an office or plant. A bag handling head 20 including a web advancing and loading/sealing mechanism is supported atop the support 10. The head 20 includes a housing or cover 20*a* that encloses a bag/web handling unit 22 (shown in FIG. 2) to be described. A main control box 24 including a control panel 24*a* is attached to the upright 10*b* and houses control circuitry (not shown) for controlling the various functions of the machine.

The base 10 also supports a supply of bags, indicated generally by the reference character S. In the illustrated embodiment, the supply S comprises at least two supply spools 25*a*, 25*b*, the spools carrying wound webs 26*a*, 26*b* of interconnected bags joined together by lines of weakness, such as transverse lines of perforations. The bag loading/sealing head 20 is operative to advance one or both webs 26*a*, 26*b* to sequentially position associated lead bags 28*a*, 28*b* at a bag loading station. With the disclosed apparatus, each web 26*a*, 26*b* can be advanced concurrently or separately in order to position a bag at one or both load stations.

As seen in FIG. 1B, the webs 26*a*, 26*b* are fed from their associated spools 25*a*, 25*b* around a pair of dancer roll assemblies 29*a*, 29*b*. The spools 25*a*, 25*b* are independently mounted on a two-part spindle 31 and the dancer roll assemblies 29*a*, 29*b* are operative to control the payout of the associated webs 26*a*, 26*b*. In particular, the dancer roll assemblies include conventional friction brake arrangements (not shown) such as the type disclosed in copending U.S. application Ser. No. 127,255 filed 12/1/87 which is hereby incorporated by reference. The friction brakes are engageable with spindle portions 31*a*, 31*b* in order to inhibit rotation of the associated supply spools 25*a*, 25*b* when a predetermined amount of web material has been paid out by the associated spool.

As seen in FIG. 1B, the bag handling head mounts a plurality of guide rolls 33*a–f* which at least partially define a web path for the webs. A bag sensor 35 (shown in FIG. 2) which may comprise a conventional perforation detector and a fixed web guide are also disposed in the web path.

After the bag or bags are loaded, the bags are sealed and severed from the remainder of the web by a sealing unit 30 and a bag tear off unit 32, respectively. The severed bag or bags are then dropped into a suitable receptacle or onto a conveyor (not shown).

Figure 2:
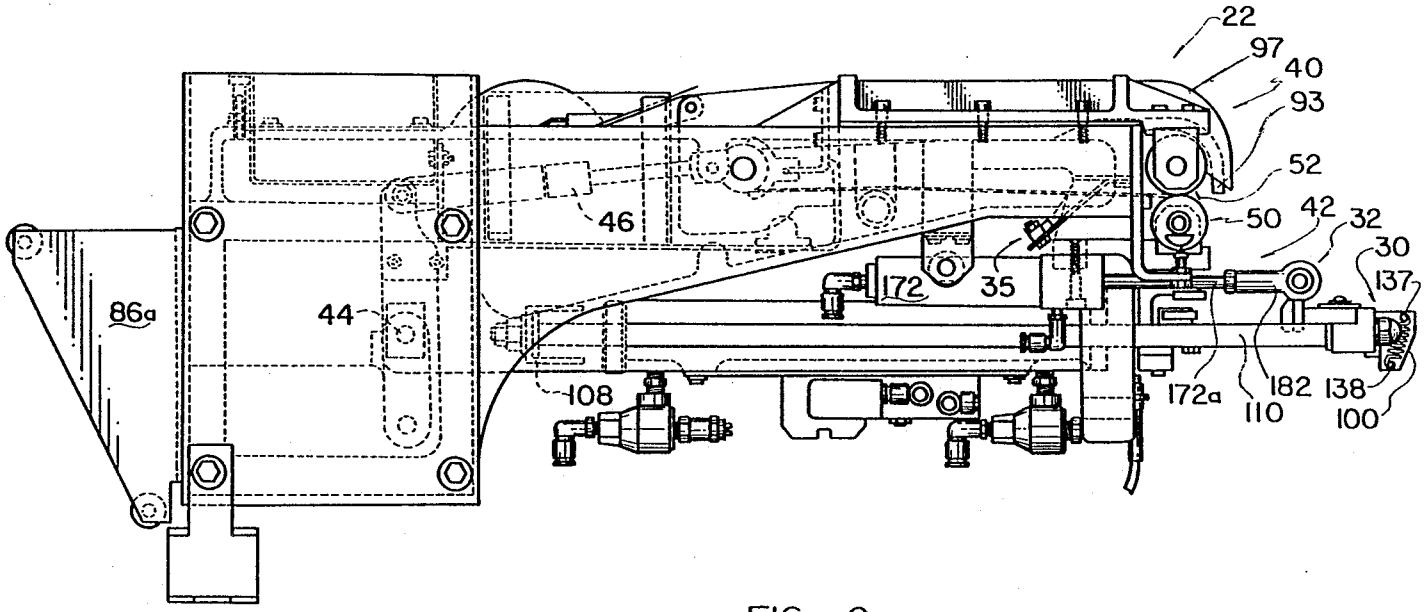
FIG. 2 is a side elevational view of a bag handling head constructed in accordance with a preferred embodiment of the invention.

The bag/web handling unit 22, as best in FIG. 2, includes upper and lower sub-assemblies indicated generally by the reference characters 40, 42. In the disclosed embodiment, the upper and lower sub-assemblies 40,42 are hingedly connected at a pivot 44 which enables the lower sub-assembly 42 to swing downwardly with respect to the upper sub-assembly 40 to facilitate loading of the web or webs. Pressurized, pneumatic actuators 46 often termed a "gas springs" interconnect the two sub-assemblies and act as a counter balance for the lower sub-assembly 42 (shown best in FIGS. 4 and 5) to facilitate the raising and lowering of the lower sub-assembly 42 by the operator.

When the lower sub-assembly 42 is pivoted to its upper position (shown in FIG. 2) a pinch roll arrangement 50 carried by the lower sub-assembly 42 engages and is driven by a feed roll arrangement 52 carried by the upper sub-assembly 40.

Figure 3:
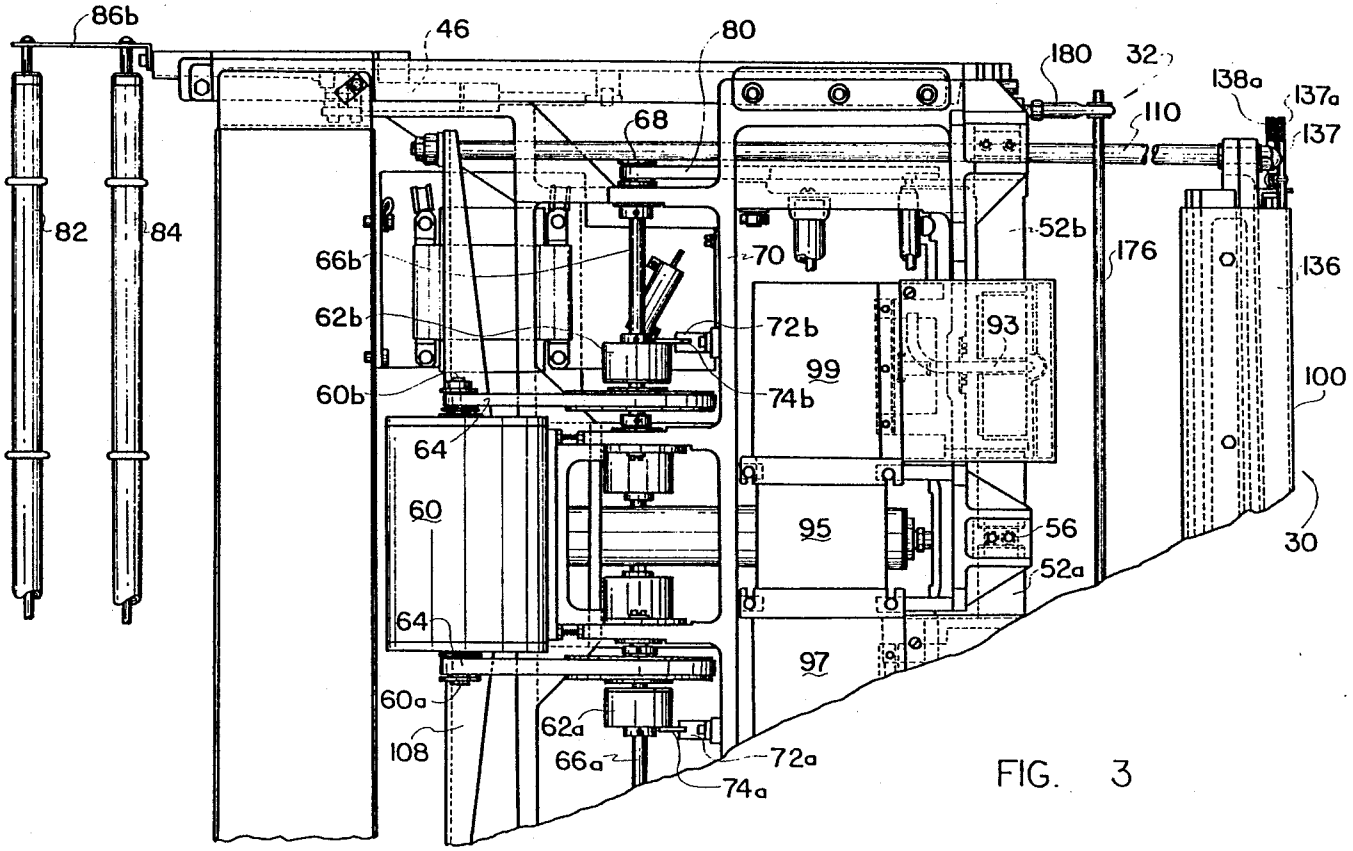
FIG. 3 is a fragmentary, plan view of the head shown in FIG. 2.
Figure 12:
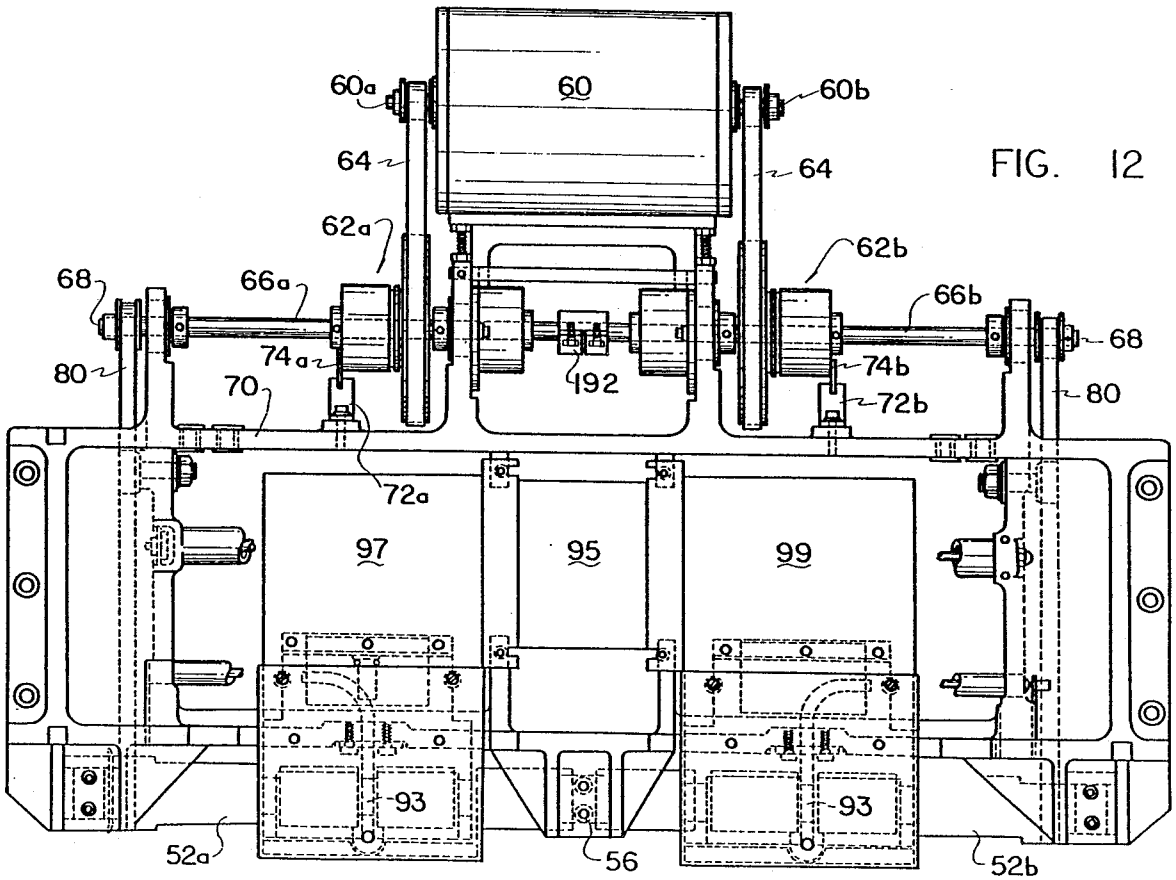
FIG. 12 is a plan view of web feed mechanism constructed in accordance with another preferred embodiment of the invention.

Referring also to FIGS. 3 and 12, the upper sub-assembly 40 carries the drive mechanism for driving the feed roll arrangement 52. According to the invention, the feed roll arrangement 52 comprises a pair of independently rotatable, axially aligned feed rolls 52*a*, 52*b* rollingly supported at their inner ends by a bearing 56. The drive system can selectively rotate either of the rolls 52*a*, 52*b* or rotate them in unison.

In one embodiment of the invention (shown in FIGS. 3 and 12) the drive system includes a drive motor 60 having output shaft ends 60*a*, 60*b*. The output shaft ends 60*a*, 60*b* are operatively connected to a pair of clutch/-brake mechanisms 62*a*, 62*b* by drive belts 64. The clutch/brake mechanisms 62*a*, 62*b* are in turn coupled to respective drive shafts 66*a*, 66*b*. The clutch/brake units are secured to a frame member 70 by brackets 72*a*, 72*b* which interlock with slotted tongues 74*a*, 74*b* forming part of the clutch units 62*a*, 62*b*. The clutch/brake units 62*a*, 62*b* may be conventional.

An outboard end 68 of the output shaft 66*a* is interconnected with the outer end of the feed roll 52*a* by a drive belt 80. The feed roll 52*b* is operatively connected with the drive shaft 66*b* through a similar arrangement. With the disclosed apparatus, rotation of the drive motor 60 can be selectively coupled to the feed rolls 52*a*, 52*b* by selective actuation of the clutch/brake units 62*a*, 62*b*. The upper sub-assembly 40 also rotatably supports a pair of guide rollers 82, 84 between side plates 86*a*, 86*b*, which are operative to guide one or both webs.

Figure 4:
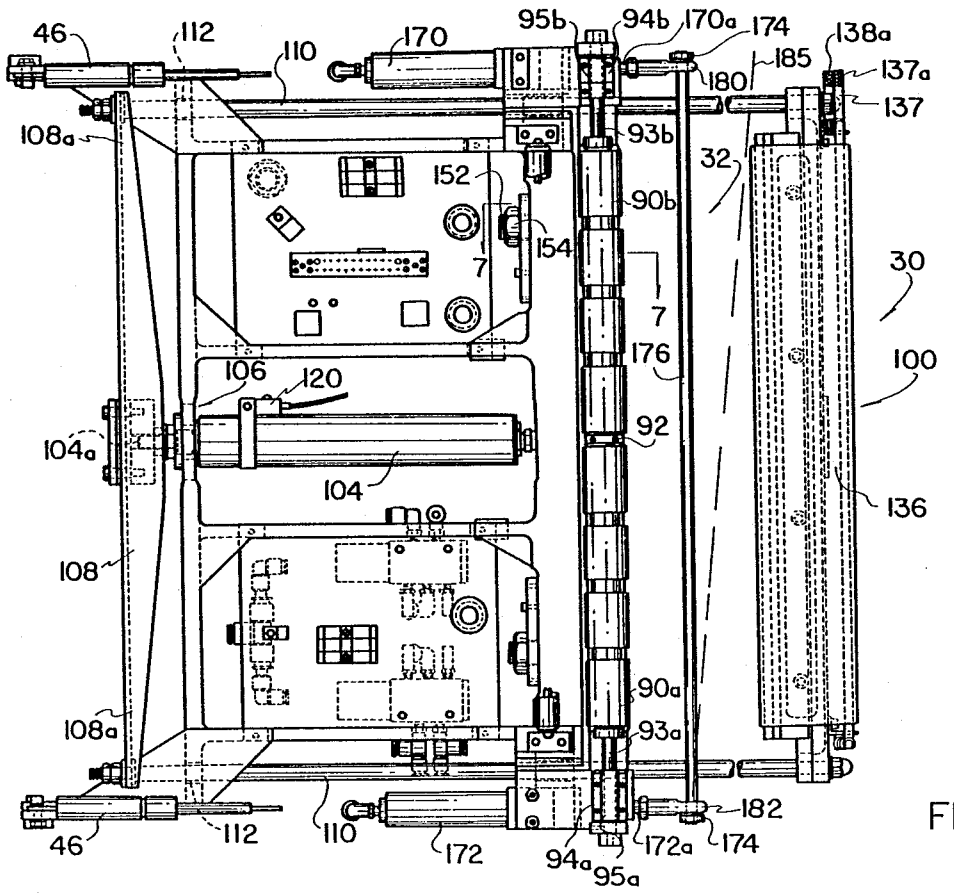
FIG. 4 is a plan view of a tear off/sealing sub-assembly forming part of the bag handling head shown in FIG. 2.
Figure 5:
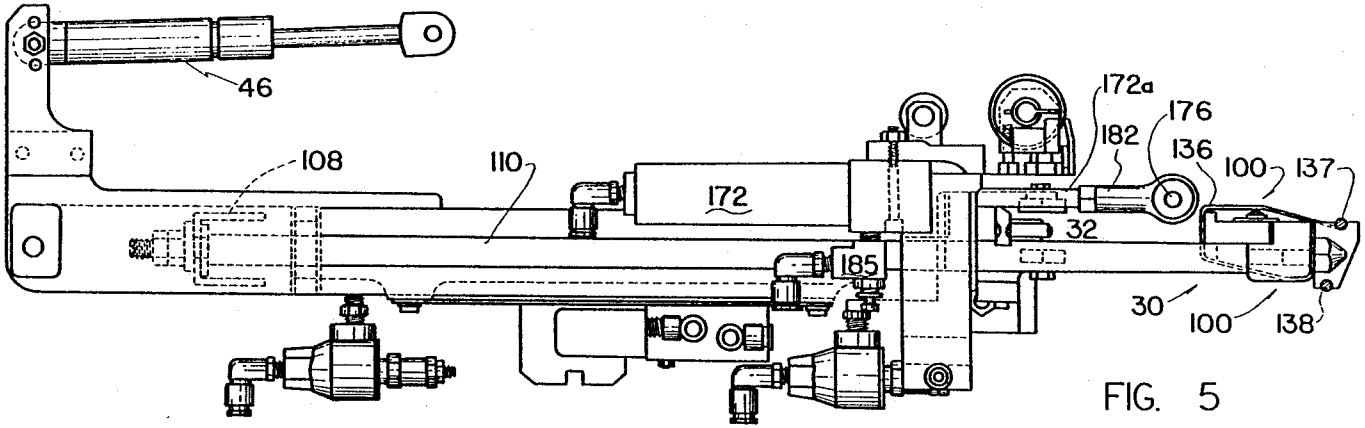
FIG. 5 is a side elevational view of the sub-assembly shown in FIG. 4.
Figure 6:
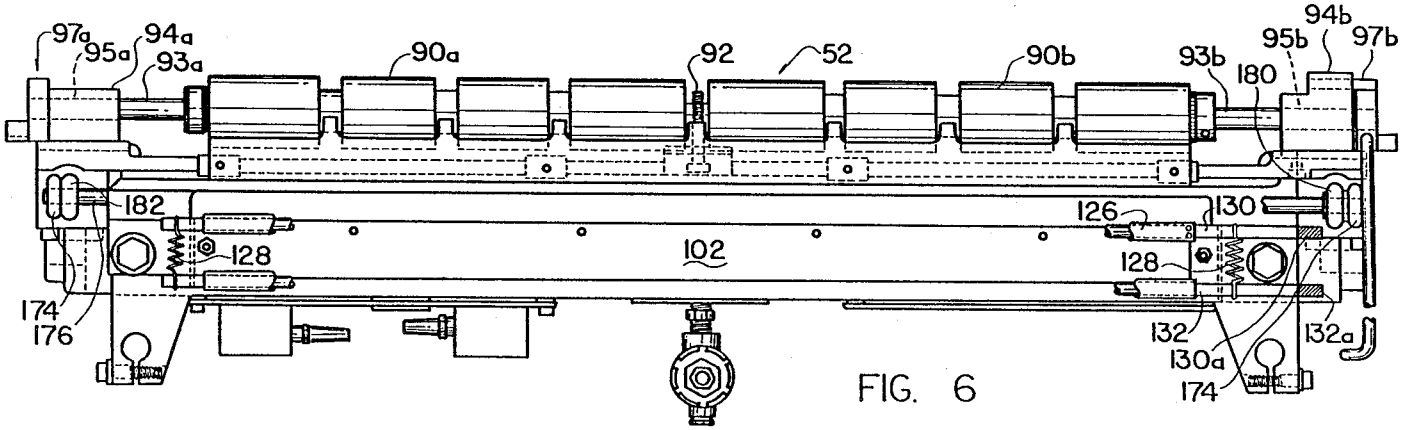
FIG. 6 is a front elevational view of the sub-assembly shown in FIG. 4.

Turning now to FIGS. 4–6, the lower sub-assembly 42, as indicated above, rotatably mounts a pinch roll arrangement 50. As seen best in FIG. 6, the pinch roll arrangement 50 comprises a pair of independently rotatable, axially aligned rolls 90*a*, 90*b*. Inner ends of the rolls 90*a*, 90*b* are rotatably supported by a bearing and bearing support assembly 92. Outer ends of the rolls 90a, 90b are defined by stub shafts 93a, 93b which are rotatably supported in respective shaft receiving bores 95a, 95b formed in frame portions 94a, 94b.

When the lower subassembly 42 is raised to its operative position, shown in FIG. 2, the pinch rolls 90a, 90b frictionally engage the feed rolls 52a, 52b, respectively. The feed rolls 52a, 52b and pinch rolls 90a, 90b together define independently actuatable, juxtaposed nip roll assemblies. Eccentric clamps 97a, 97b are mounted at opposite sides of the lower assembly 42 and are engageable with associated clamp structure formed on the upper assembly 40. When the lower assembly is raised, the eccentric clamps are used to lock the lower assembly to the upper assembly and cause the feed rolls 52a, 52b to engage the pinch rolls, 58a, 58b with a predetermined clamping pressure.

In normal operation, the lower sub-assembly 42 is lowered in order to load the web or webs 26a, 26b from the supply S. In particular, if two independent webs or chains of bags are to be loaded, the respective webs are fed around one or both guide rolls 82, 84 then are draped across the pinch rolls 90a, 90b, respectively. When the lower unit 42 is raised to its operative position, the web 26a is clamped between the feed roll 52a and the associated pinch roll 90a whereas the web 26b is clamped between the feed roll 52b and the associated pinch roll 90b. In normal operation, when the machine is turned on, the drive motor 60 is continuously energized. The individual webs are advanced by selectively actuating the clutch/brake units 62a, 62b associated with the webs 26a, 26b. In particular, if the web 26a (which is clamped between the nip roll assembly formed by the feed/pinch rolls 52a, 90a) is to be advanced, the clutch/brake unit 62a is actuated. After the web is advanced, the associated clutch/brake unit is normally energized into its braking mode so that movement in the web 26a upstream of the lead bag 28a is resisted. As a consequence, uncontrolled movement in the web 26a (and web 28a, if applicable) is inhibited or prevented.

As the bags 28a, 28b reach the load position (shown in FIG. 1), they are blown or "popped" open in order to receive a product or products. In general the bags each include a transverse slit in one of the plies that define an outer sidewall. As seen best in FIG. 12, the bag handling head 22 includes a pair of bag opening units 97, 99 connected to a common blower 95. Each unit 97, 99 includes a nozzle for directing blower air downwardly towards the mouth of a bag positioned below the unit. The blower is normally operated continuously during the loading process and provides a source of relatively low pressure air for maintaining inflation of the bag. In addition, the blower preferably includes a speed control (not shown) for adjusting the blower pressure. With this control arrangement, when relatively light products are being loaded, i.e., such as powders, the blower pressure can be reduced to a minimum level so that the product is not blown from the bag during filling.

In the preferred and illustrated embodiment, the bag is initially popped opened by a blast of air from a "blip" tube 93 mounted to each opening unit 97, 99. The blip tube 93 is connected to a source of pressurized air, the communication of which is determined by a valve (not shown) that may be actuated by a conventional valve control system. In general, the tube is connected with a source of pressurized air momentarily as the associated bag reaches the load position. The blower 95 is then used to maintain the opening of the bag.

After the lead bags 28a, 28b have been loaded, the sealing mechanism 30 is operated in order to form a heat seal across the top of the bags (if the machine is being used to load two webs). Referring to FIGS. 4–9, the mechanism for forming the heat seal includes a reciprocally moveable pressure bar 100 (shown best in FIGS. 3–5), which is moved towards and away from a heating unit 102 (shown best in FIGS. 7–9) by an actuator 104.

As seen best in FIG. 4, the actuator 104 is mounted centrally in a frame 106 forming part of the lower subassembly 42 and includes an actuating rod 104a which mounts a channel-like cross member 108. Guide rods 110 are secured to distal ends 108a of the sealer cross member 108 and extend toward the front of the machine and are slidably received (and supported) by bores 112 formed in the frame 106. Other bores (not shown) slidably received the guide rods 110 and support the rods 110 near the front of the machine. The pressure bar 100 extends between the front ends of the guide rods 110 so that when the actuator 104 is energized to extend the actuating rod 104a, the pressure bar 100 is pulled inwardly towards the heating unit 102. A position detector 120, (the function of which will be described further on) is mounted to the actuator 104 and detects when a portion of the actuator i.e., the piston, moves to a predetermined position within the actuator housing which corresponds to a predetermined position of the pressure bar 100.

Figure 7:
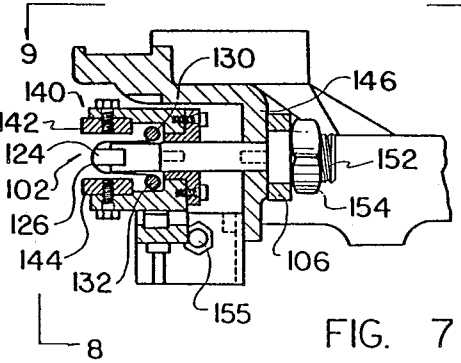
FIG. 7 is a fragmentary, sectional view as seen from the plane indicated by the line 7—7 in FIG. 4.
Figure 8:
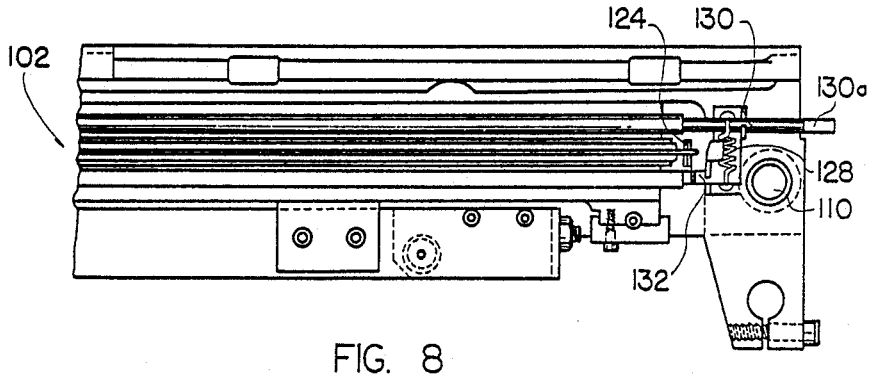
FIG. 8 is a fragmentary, sectional view as seen from the plane indicated by the line 8—8 in FIG. 7.
Figure 9:
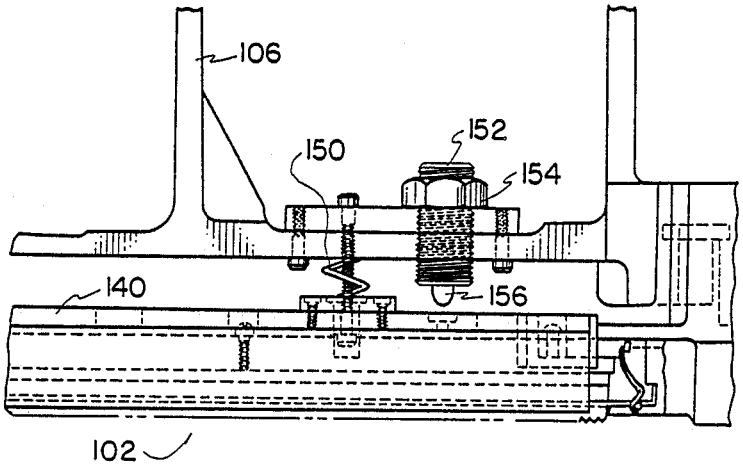
FIG. 9 is a fragmentary, sectional view as seen from the plane indicated by the line 9—9 in FIG. 7.

Referring also to FIGS. 7–9, the heater unit 102 includes a heating element 124 shown best in FIG. 7. Various heating elements can be employed. For example, the sealing unit may include the heating element and control system disclosed in U.S. application No. 031,750, on Mar. 30, 1987, which is owned by the present assignee.

As seen best in FIG. 7, a non-stick material 126, such as a band of teflon is wrapped over the heating region and around a pair of shafts 130, 132. Tension springs 128 maintain the positions of the shafts 130, 132. One of the shafts serves as a supply spindle whereas the other shaft serves as a take-up spindle. The teflon band 126 inhibits the bag being sealed from sticking to the heating unit when the heat sealing cycle is completed. The shafts 130, 132 include knurled ends 130a, 132a (shown best in FIG. 6), which enable a user to rotate at least one of the shafts in order to pull fresh anti-stick material from the other shaft. The bag contacting surface on the pressure bar 100 is also covered with a non-stick material such as teflon. As seen best in FIGS. 4 and 5, a band of material 136 is wrapped around the inside of the pressure bar 100 and between supply and take-up shafts 137, 138. Each shaft includes knurled ends 137a, 138a.

A sealer bar assembly 140 is mounted to the heating unit 102 and includes a pair of gripper elements 142, 144 (shown best in FIG. 7) disposed above and below, respectively the heating element 124. The entire sealer bar assembly 140 is reciprocally mounted in a housing indicated generally by the reference character 146 and retracts inwardly as a bag is clamp between the pressure bar 100 and the gripper elements 142, 144 thereby contacting the teflon covered heating element 124 in order to form a heat seal on the bag. Referring to FIG. 9, the sealer bar 140 is resiliently biased towards the position shown in FIG. 7. In particular, at least two relatively light springs 150 (only 1 is shown in FIG. 9) urges the sealer bar 140 outwardly, towards the pressure bar 100 i.e., to the position shown in FIG. 9.

When the pressure bar 100 contacts the seal bar 140, it moves the seal bar rearwardly since the force applied by the pressure bar 100 easily exceeds the force applied by the relatively light-force biasing springs 150. After the bar moves a predetermined distance, further movement in the seal bar 140 is resisted by a relatively heavy-force spring biased plunger unit 152 which is threadedly mounted to the frame 106 and is locked in position by a jam nut 154. A plunger stem 156 extends outwardly from the unit 152 and is abuttably engageable with the back of the sealer bar 140. In the illustrated embodiment, the rear of the sealer bar 140 includes recesses adapted to receive a tip of the plunger stem 156. The spring force exerted by the plunger unit 152 is substantially higher than the force applied by the positioning springs 150 and further rearward movement of the sealer bar 140 is substantially resisted. This resistance to movement generates a clamping force between the pressure bar 100 and the seal bar 140. The clamping force is needed in order to provide a strong heat seal because it ensures that the plies of the loaded bag are placed in intimate contact. In addition the clamping force isolates the loaded bag from the rest of the web and as a result further movement in the bag due to external forces generated by product weight and web severance, is substantially resisted.

This arrangement provides a significant feature of the invention. With the disclosed clamping arrangement, obstructions in the path of travel of the pressure bar 100 can be detected enabling the sealing cycle to be terminated before damage occurs to the obstruction and/or the sealing mechanism. In particular, a sensor 155 (shown only in FIG. 7) monitors the position of the sealing bar 140. When the sealing bar 140 is not in contact with the pressure bar 100, the sealing bar 140, as described above, should be in the position shown in FIG. 9. During the sealing operation, the sealer bar 140 is moved inwardly until it contacts the spring biased plunger 156. In a normal heat sealing cycle, the seal bar 140 should not move to the position at which it engages the plunger 156 until the pressure bar 100 has moved into substantially abutting engagement with the gripper elements 142, 144 since in normal operation the pressure bar 100 and the gripper elements 142, 144 should only be separated by the thickness of the sidewalls or plies of the bag. If the path of travel of the pressure bar 100 is obstructed by an improperly loaded or improperly positioned bag, the seal bar 140 will move rearwardly into contact with the plunger 156 well before the pressure bar 100 reaches a position immediately adjacent the gripper elements 142, 144. By monitoring the position of the seal bar 140 and the pressure bar 100, the presence of an obstruction can be detected. The position of the pressure bar 100 is monitored by the sensor 120 mounted to the actuator 104. In the disclosed embodiment, the position of the actuator piston (not shown) that corresponds to the adjacent position of the pressure bar 100 is monitored. If the seal bar assembly 140 moves rearwardly before the piston reaches the predetermined sensor position, control circuitry immediately terminates the heat seal cycle and returns the pressure bar 100 to its outward or retracted position. Consequently, significant forces are not applied to the bag if an obstruction is present or if the bag is improperly positioned.

According to the invention, the loaded bag is severed from the remainder of the web while the bag is clamped by the heat sealing unit 102. In the preferred embodiment, the bag is severed by a bag tear off mechanism which is operative to sever the loaded bag along a line of perforations, commencing at a marginal edge of the bag and proceeding towards the opposite marginal edge of the bag. The apparatus for achieving this function is best shown in FIGS. 3 and 4. In particular, a pair of double acting actuators 170, 172 are mounted on opposite sides of the frame 106. Each actuator includes a respective actuating rod **170*a*, 172*a*. A rod-like tear off member 176 is supported between the ends of the rods 170*a*, 172*a*. In the preferred construction, spherical bearings are mounted at opposite ends of the tear off rod 176 and are conventionally held in spherical bearing retainers 180, 182 mounted to the ends of the actuator rods 170*a*, 172*a*. Retaining collars 174 are fixed to the ends of the tear off rod 176 and maintain its position between the actuators 170, 172 while allowing some axial movement in the tear off rod 176**.

According to the invention, the actuators 170, 172 are not operated in unison so that movement in the tear off rod 176 occurs non-linearly or angularly with respect to the plane of the web. In particular, the actuation of the actuators 170, 172 is controlled so that one end of the rod 176 moves outwardly before the other end so that contact occurs with a bag to be served at its marginal edge closest to the end of the tear off rod 176 being moved first. For example, the actuator 170 may be energized first in order to move the upper end of the tear off rod 176 (as viewed in FIG. 4) outwardly to the position indicated by the phantom line 185. After the upper end of the rod has moved a predetermined distance, the actuator 172 is energized to move the lower end (as viewed in FIG. 4) outwardly in order to complete the tear off cycle. With the disclosed arrangement, separation of the loaded bag from the rest of the web (along the line of weakness) does not occur simultaneously across the entire width of the bag but begins at one marginal edge and moves towards the other marginal edge. As a result, reduced forces are applied to the bag to effect the severance.

In the illustrated embodiment, the actuators 170, 172 are pneumatically operated and in the preferred control system, the sequential movement of the actuating rods **170*a*, 172*a* is achieved by restricting the flow of the fluid pressure to one of the actuators. In particular, an adjustable flow restrictor 185 (shown best in FIG. 5) is disposed in the flow path feeding the actuator 172 and restricts fluid flow into the rod end of the actuator. With this arrangement, the control system is simplified. When bag severance is to occur, supply lines feeding both actuators 170, 172 can be pressurized simultaneously by the operation of a single valve. The delay in extension of one of the actuating rods (i.e. the actuator 172**) is achieved by restricting the flow of pressurized fluid to the one actuator. Ultimately, both actuators are fully pressurized for maximum force.

Thus far the invention has been described as it would be used to simultaneously handle, two independent chains of bags. The invention, however, can be used to load and seal a single chain of bags. The disclosed apparatus can handle a narrow web of bags, i.e., a web having a transverse dimension less than the transverse dimension of the drive roll portions **52*a*, 52*b* as well as a relatively wide web i.e. a web having a transverse dimension that exceeds the transverse dimension of the individual feed roll portions 52*a*, 52*b*. In fact, a single web having a width equalling the total transverse dimension of the axially aligned feed roll portions 52a, 52b can be used. Although the clutch units 62a, 62b can be simultaneously actuated in order to provide coordinated movement in both nip roll assemblies, in the preferred embodiment, a mechanical coupling 192 can be used to mechanically interconnect inner ends 194a, 194b of the drive shafts 66a, 66b. With the mechanical coupling 192, synchronized movement in both drive roll portions 52a, 52b** is assured.

As should be apparent, the present invention provides a versatile machine which can be used to simultaneously load two individual chains of bags. The bags comprising the chains are not required to be the same size and bags having substantially dissimilar dimensions can be simultaneously handled by the disclosed machine. In addition, the machine can be used to fill extremely wide bags by synchronizing movement in the individual feed roll portions 52a, 52b, in order to feed a single wide web through the machine.

Figure 11:
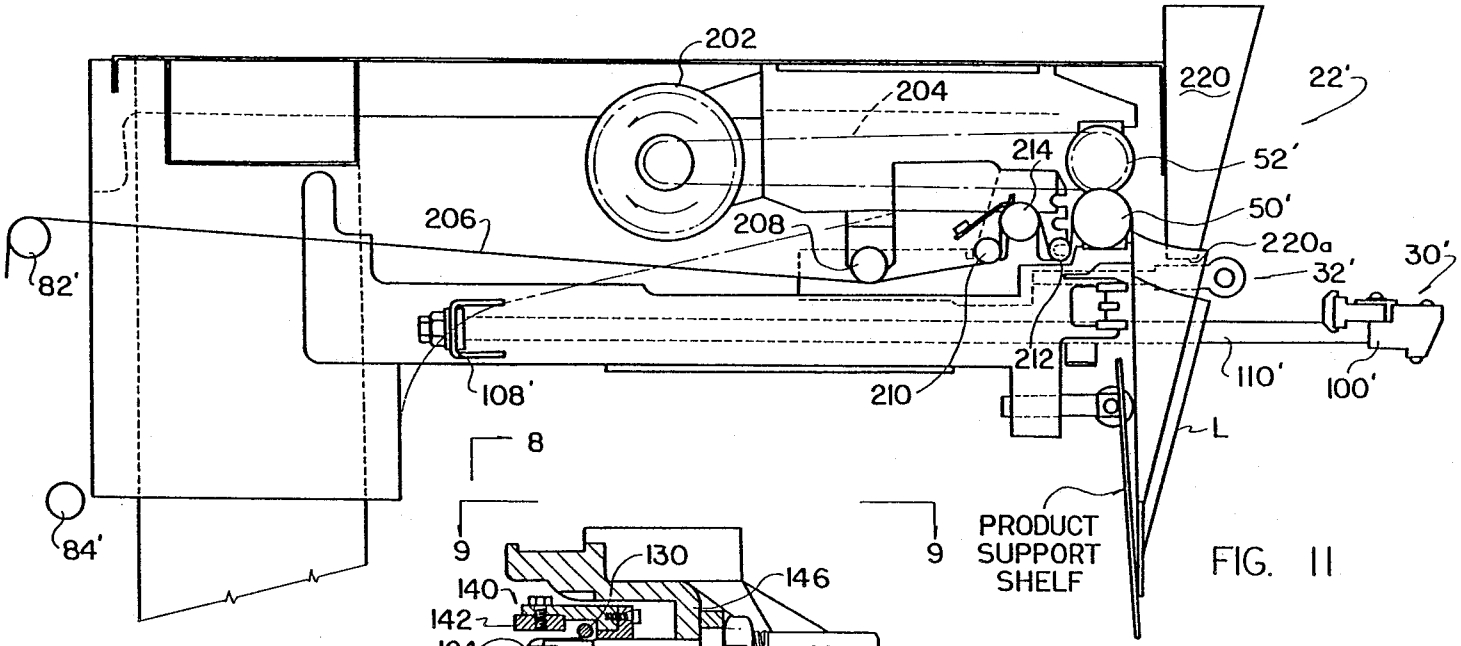
FIG. 11 is a fragmentary, plan view of the drive system shown in FIG. 10.
Figure 10:
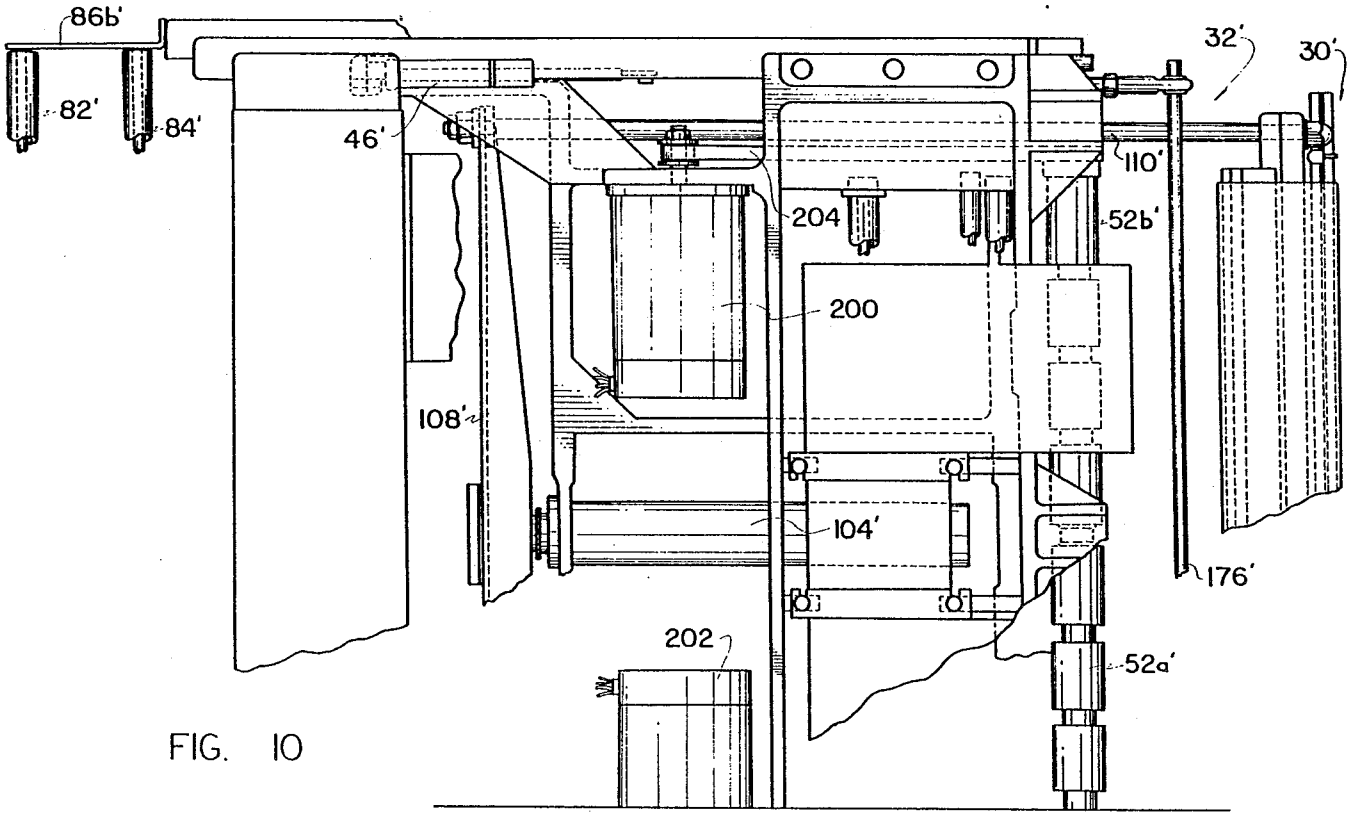
FIG. 10. is a plan view, shown somewhat schematically, of an alternate web drive system constructed in accordance with the invention.

Turning now to FIGS. 10 and 11, an alternative embodiment of the invention is illustrated. In describing this alternate embodiment, the components having similar counterparts in the earlier described embodiment will be designated with the same reference character followed by an apostrophe (').

In this embodiment, individual stepper motors 200, 202 are used to selectively drive the individual nip roll assemblies formed by feed roll portions 52a', 52b' and associated pinch roll portions. In particular, the stepper motors 200, 202 are directly connected to an associated ends of the feed roll portions 52b', 52a' by a drive belt 204 (only the drive belt 204 connecting the stepper motor 200 to the feed roll 52b' is shown in FIG. 10).

As seen best in FIG. 11, a web comprising a chain of bags 206 defines a web path through the unit 22'. Guide rolls 208, 210, 212 are provided and at least partially define the web path. A conventional perforation detecting sensor 214 is used to detect the position of the bag. With this embodiment, a conventional stepper motor control circuit is employed to advance a lead bag "L" to a load position by advancing the web a certain number of steps after a line of perforations (along which contiguous bags are joined) is detected. The number of steps corresponds to the distance that must be traveled by the lead bag in order to be properly positioned at that load station.

In addition, the disclosed stepper motor drive system can be used to cause an open bag to engage a mouth 220a of a loading funnel 220. In particular, with the disclosed mechanism, the lead bag "L" is advanced to an initial load position at which it is inflated by a blower/blip tube unit (or units) such as the units 97, 99 shown in FIG. 12 and described above. After the bag L is opened, the associated stepper motor is reverse actuated to raise the bag "L" upwardly (as viewed in FIG. 11) in order for the opening in the bag to engage the mouth 220a of the funnel 220. The stepper motor would be retracted a certain number of steps corresponding to the distance a bag must be raised in order to engage the mouth of the funnel. At the completion of the loading cycle, the bag is sealed and severed by a sealing and severing mechanisms 30, 32 shown in FIG. 1A and described above.

The stepper motor drive system can also be used to replace the function provided by the tear-off mechanism 32. In particular, when the loaded bag or bags are being held by the sealer assembly 30, the stepper motors 200, 202 can be actuated to reverse feed the web. Since the bags are held by the sealer assembly 30, the web or webs are severed from the loaded bags along their respective lines of weakness.

According to a feature of this embodiment, the forces applied to the webs during the severance process can be substantially reduced. In particular, the stepper motors 200, 202 can be reverse stepped in a staggered fashion so that one web begins the severance process before the other web. As a result, the severance occurs gradually across both the webs and the stepper motors 200, 202 need not apply a force to the webs in an amount that would be needed to produce a concurrent severance across both webs simultaneously. In short, the power needed to produce severance is substantially reduced when the stepper motors 200, 202 are reverse stepped in a staggered fashion.

The disclosed stepper motor drive is capable of extremely precise positioning of a bag. In addition, the drive can either advance and/or retract the webs individually or concurrently. Like the first embodiment, this alternate embodiment can be used to handle two webs simultaneously or a single relatively wide web i.e. a web having a transverse dimension substantially equal to the total transverse dimension of the feed roll portions 52a', 52b'.

Although, the invention has been described with a certain degree of particularity, it should be understood that those skilled in the art can make various changes to it without departing from the spirit or scope of the invention as hereinafter claimed.

We claim:

1. A packaging apparatus, comprising:

(a) structure establishing a path of travel for at least two independent packaging webs, each web comprising at least one longitudinal chain of interconnected, bag-like containers, contiguous containers being interconnected with each other along a transverse line of weakness;

(b) an advancing means including a nip roll assembly associated with each of said webs and a drive means for selectively actuating said nip roll assemblies to selectively advance said webs; and, (c) each of said nip roll assemblies including a feed roller and a pinch roller, said feed rollers being axially aligned;

(d) a heat sealing unit including a heating element and a sealer bar having a first bag engaging surface;

(e) a pressure bar including a second bag engaging surface, reciprocally mounted for movement towards and away from said sealer bar, said pressure bar operative to exert a clamping force to sidewalls of a bag held between said sealer bar and said pressure bar;

(f) biasing means resiliently biasing one of said bag engaging surfaces towards an extended position;

(g) monitoring means for monitoring said extended position of said resiliently biased bag engaging surface and a position of said pressure bar, said monitoring means operative to cause said pressure bar to retract to a spaced positioned upon sensing movement in said resiliently biased surface before said pressure bar has moved to a predetermined position with respect to said heat sealing unit.

2. A packaging apparatus, comprising:

(a) structure establishing a path of travel for at least two independent packaging webs, each web comprising at least one longitudinal chain of interconnected, bag-like containers, contiguous containers being interconnected with each other along a transverse line of weakness;

(b) an advancing means including a nip roll assembly associated with each of said webs and a drive means for selectively actuating said nip roll assemblies to selectively advance said webs;

(c) each of said nip roll assemblies including a feed roller and a pinch roller, said feed rollers being axially aligned;

(d) a tear off member mounted for movement into and out of a web path; and, (b) actuating means operative to drive one end portion of said tear off member into said web path before another end portion of said tear off member moves such that said web is engaged by said one end portion, in a region including said line of weakness, before said other end portion of said tear off member engages said web whereby severance of a bag-like container from said web begins at one marginal edge and proceeds towards another marginal edge of said web.

3. The apparatus of claim 2 wherein said drive means comprises a drive motor having an output shaft and a clutch unit associated with each of said nip roll assemblies, said clutch unit selectively actuatable in order to couple said drive motor output shaft to a nip roll assembly associated with said clutch unit.

4. A sealing apparatus for closing a bag-like container having two overlapping sidewalls, said sealing apparatus comprising;

(a) a heat sealing unit including a heating element and a resiliently biased sealer bar;

(b) a pressure bar, reciprocally mounted for movement towards and away from said sealer bar, said pressure bar operative to exert a clamping force to sidewalls of a bag held between said sealer bar and said pressure bar;

(c) monitoring means for monitoring a position of said sealer bar and said pressure bar, said monitoring means operative to cause said pressure bar to retract to a spaced positioned upon sensing movement in said sealer bar before said pressure bar has moved to a predetermined position with respect to said sealer bar.

5. A packaging apparatus, comprising:

(a) structure establishing a path of travel for at least two independent packaging webs, each web comprising at least one longitudinal chain of interconnected, bag-like containers, contiguous containers being interconnected with each other along a transverse line of weakness;

(b) an advancing means including a nip roll assembly associated with each of said webs and a drive means for selectively actuating said nip roll assemblies to selectively advance said webs; and, (c) each of said nip roll assemblies including a first roller and a second roller in frictional engagement, said first rollers being axially aligned;

(d) said drive means including:

(i) a stepper motor operatively connected with each nip roll assembly; and, (ii) a control system for selectively actuating each of said stepper motors in order to advance a web associated with the nip roll assembly connected to said stepper motor a predetermined distance in response to detecting a web position indicating means on said web.

6. The packaging apparatus of claim 5 wherein said first roller is a feed roller and said second roller is a pinch roller.

7. The apparatus of claim 5 wherein said position indicating means on said web comprises a line of weakness.

8. The apparatus of claim 1 wherein said drive means is operative to reverse-step said stepper motors in order to sever a web from a loaded bag, while said loaded bag is being held by a holding means.

9. The apparatus of claim 8 wherein said stepper motors are reverse stepped in a staggered fashion in order to produce a gradual severance of said webs from said loaded bags.

10. The apparatus of claim 9, wherein said holding means comprises a sealing apparatus.

11. The apparatus of claim 10 wherein said sealing apparatus includes:

(a) a heat sealing unit including a heating element and a resiliently biased sealer bar;

(b) a pressure bar, reciprocally mounted for movement towards and away from said sealer bar, said pressure bar operative to exert a clamping force to sidewalls of a bag held between said sealer bar and said pressure bar;

(c) monitoring means for monitoring a position of said sealer bar and said pressure bar, said monitoring means operative to cause said pressure bar to retract to a spaced position upon sensing movement in said sealer bar before said pressure bar has moved to a predetermined position with respect to said sealer bar.

12. The apparatus of claim 5 wherein at least one of said webs comprises two side-by-side connected packaging strips, each strip comprising a chain of interconnected bag-like containers joined together along transverse lines of weakness.

13. The apparatus of claim 8 wherein said stepper motors are reverse stepped in a staggered fashion in order to produce a sequential severance of said webs from said loaded bags.

14. A packaging apparatus comprising:

(a) structure establishing a path of travel for at least two independent packaging webs, each web comprising at least one longitudinal chain of interconnected, bag-like containers, contiguous containers being interconnected with each other along a transverse line of weakness;

(b) an advancing means including a nip roll assembly associated with each of said webs and a drive means for selectively actuating said nip roll assemblies to selectively advance said associated web;

(c) each of said nip roll assemblies including a feed roller and a pinch roller;

(d) a sealing mechanism for closing said bag-like containers after loading including:

(i) a heat sealing unit including a heating element and a spring biased sealer bar;

(ii) a pressure bar, reciprocally mounted for movement towards and away from said sealer bar, said pressure bar operative to exert a clamping force to a container held between said sealing bar and said pressure bar;

(iii) monitoring means for monitoring the position of said sealer bar and said pressure bar, said monitoring means operative to cause said pressure bar to retract to a spaced position upon sensing movement in said sealer bar before said pressure bar is moved to a predetermined position with respect to said sealer bar;

(e) a tear-off mechanism for severing said loaded containers from their associated webs including:

(i) a tear off member mounted for movement into and out of a web path;

(ii) actuating means operative to drive one end portion of said tear off member into said web path before another end portion of said tear off member moves such that said web is engaged by said one end portion, in a region including said line of weakness, before said other end portion of said tear off member engages said web whereby severance of said bag from said web begins at one marginal edge and proceeds towards the other marginal edge of said web.

15. The apparatus of claim 14 wherein at least one of said webs comprises two side-by-side interconnected longitudinal chains of bag-like containers.

16. Apparatus for severing a loaded bag from a web of bags interconnected along transverse lines of weakness, said apparatus comprising;

(a) a tear off member mounted for movement into and out of a web path;

(b) actuating means operative to drive one end portion of said tear off member into said web path before another end portion of said tear off member moves such that said web is engaged by said one end portion, in a region including said line of weakness, before said other end portion of said tear off member engages said web whereby severance of said bag from said web begins at one marginal edge and proceeds towards the other marginal edge of said web.

17. (The apparatus of claim 16 wherein said tear off member is supported at opposite ends by actuators and a control system begins extending one of said actuators before extending the other actuator.

18. The apparatus of claim 17 wherein a delay in the extension of said other actuator is achieved by restricting the flow of pressurized fluid to said other actuator.

19. The apparatus of claim 18 wherein said delay in actuating one of said actuators is achieved by a flow restriction disposed in a flow path feeding pressurized fluid to said one actuator.

20. In an apparatus for loading two chains of interconnected bags, a bag severing arrangement for severing at least two loaded bags held by a sealing mechanism, comprising:

(a) a stepper motor and nip roll assembly connected to said stepper motor associated with each web;

(b) control means for forward and reverse stepping each of said stepper motors;

(c) means for reverse stepping said stepper motors while said loaded bags are held by said sealing apparatus in order to produce severance of said webs along associated transverse lines of weakness located between said webs and said loaded bags.

21. The apparatus of claim 20 wherein said control means includes means for reverse stepping said stepper motors in a staggered fashion in order to produce gradual severance of said bags from said webs.

22. A sealing apparatus for closing a bag-like container having two overlapping sidewalls, said sealing apparatus comprising;

(a) a heat sealing unit including a heating element and a sealer bar having a first bag engaging surface;

(b) a pressure bar including a second bag engaging surface, reciprocally mounted for movement towards and away from said sealer bar, said pressure bar operative to exert a clamping force to sidewalls of a bag held between said sealer bar and said pressure bar;

(c) biasing means resiliently biasing one of said bag engaging surfaces towards an extended position;

(d) monitoring means for monitoring movement in said resiliently biased bag engaging surface and a position of said pressure bar, said monitoring means operative to cause said pressure bar to retract to a spaced positioned upon sensing movement in said resiliently biased surface before said pressure bar has moved to a predetermined position with respect to said heat sealing unit.

23. The apparatus of claim 22 wherein said resiliently biased surface is said first bag engaging surface.

* * * * *